United States Patent [19]

Grossman

[11] Patent Number: 4,700,516

[45] **Date of Patent: * Oct. 20, 1987**

[54] COMPOSITE, PRE-STRESSED STRUCTURAL MEMBER AND METHOD OF FORMING SAME

[75] Inventor: Stanley J. Grossman, Norman, Okla.

[73] Assignee: Keith and Grossman Leasing Company, Norman, Okla.

[ * ] Notice: The portion of the term of this patent subsequent to Jan. 15, 2001 has been disclaimed.

[21] Appl. No.: 688,272

[22] Filed: Jan. 2, 1985

Related U.S. Application Data

[62] Division of Ser. No. 324,980, Nov. 25, 1981, Pat. No. 4,493,177.

[51] Int. Cl.[4] ..... E04C 3/26; E04C 3/294; B28B 9/04

[52] U.S. Cl. ..... 52/223 R; 52/334; 52/745; 264/228

[58] Field of Search ..... 52/223 R, 334, 745; 264/228

[56] References Cited

U.S. PATENT DOCUMENTS

| | | | |
|---|---|---|---|
| 1,770,932 | 7/1930 | Leake | 52/225 X |
| 2,373,072 | 4/1945 | Wichert | 52/223 R |
| 2,382,138 | 8/1945 | Cueni . | |
| 2,382,139 | 8/1945 | Cueni . | |
| 2,413,990 | 1/1947 | Muntz | 52/223 R |
| 2,558,946 | 7/1951 | Fromson | 52/334 X |
| 2,725,612 | 12/1955 | Lipski . | |
| 3,166,830 | 1/1965 | Greulich | 52/225 X |
| 3,305,612 | 2/1967 | Frantz | 264/69 |
| 3,588,971 | 6/1971 | Lipski . | |
| 3,608,048 | 9/1971 | Lipski | 264/228 |
| 4,093,689 | 6/1978 | Mayer et al. | 264/71 |
| 4,279,680 | 7/1981 | Watson, Jr. | 156/212 |
| 4,493,177 | 1/1985 | Grossman | 52/745 |

FOREIGN PATENT DOCUMENTS

| | | | |
|---|---|---|---|
| 1296632 | 5/1962 | France | 52/334 |
| 1332590 | 6/1963 | France | 52/334 |
| 777172 | 11/1980 | U.S.S.R. | 52/225 |

*Primary Examiner*—Alfred C. Perham

*Attorney, Agent, or Firm*—Laney, Dougherty, Hessin & Beavers

[57] ABSTRACT

A composite, pre-stressed structural member comprised of concrete and a lower metal support member, and method for forming and pre-stressing the same. The metal support member and a concrete mold are connected for parallel deflection with the support member uppermost and shear-connectors extending into the mold. The connected mold and support member are supported for deflection and concrete is poured into the mold and allowed to harden. During hardening of the concrete the mold and support member are deflected by the weight of the concrete, mold and support member, pre-stressing the support member. Upon hardening of the concrete and inverting to a concrete-uppermost position, a composite, pre-stressed structural member is provided.

17 Claims, 10 Drawing Figures

COMPOSITE, PRE-STRESSED STRUCTURAL MEMBER AND METHOD OF FORMING SAME

This application is a division of application Ser. No. 324,980, filed Nov. 25, 1981, now U.S. Pat. No. 4,493,177 issued Jan. 15, 1985.

BACKGROUND OF THE INVENTION

1. Field of the Invention

This invention relates in general to structural members and methods of forming structural members. More particularly, but not by way of limitation, it relates to composite, pre-stressed structural members and methods and apparatus for forming, designing and pre-stressing such structural members.

2. Description of the Prior Art

In the prior art there are a wide variety of structural members, both prefabricated and fabricated in place. These structural members include single element members such as steel beams and composite element members such as concrete reinforced with or supported by metal bars or support beams and elements. The combinations and shapes of these types of structural elements are, of course, numerous.

In forming structural members which include concrete elements or which are entirely made of concrete it has often been found desirable to prestress the concrete to reduce tension loads on the concrete. It is well known that concrete can withstand relatively high compression stresses but only relatively low tension stresses. Accordingly, wherever concrete is to be placed in tension it has been found desirable to prestress the concrete structural member with a compression stress which remains in the structural member and must be overcome before a failing tension will be achieved.

Conventional pre-stressing as performed in the past involves stretching a metal wire or cable through a mold and placing this cable in tension during hardening of concrete which has been poured into the mold. When the concrete has hardened the tension-loaded cable is cut placing a compression load on the hardened concrete. The compression force from the severed cable remains with the element once it is removed from the mold.

A problem with conventional prestressing it that it requires careful calculations to avoid overstressing the cables because it is usually desirable to stretch the cables to near failure to achieve a sufficient pre-stressing. The apparatus, to achieve this pre-stresssing, is also complex. Still further, cutting the cables can be a dangerous procedure and can ruin the pre-stressed structural member if not performed correctly.

In forming structural members for spanning between two supports it has often been found desirable to utilize a steel structural support beneath a molded concrete surface. Because steel can withstand a much higher tensile stress these composite structural members are formed with the steel sustaining most of the tensile stress which is placed on the member. In general, these types of structural members do not include any type of prestressing.

To form composite members of the type having an upper concrete surface and a metal structural support underneath a multiple piece form mold is utilized. First, the steel supports such as wide flange beams are placed beneath a mold assembly having two or more mold pieces disposed about the beam or beams. Next, the concrete is poured into the mold such that the concrete fills the mold and extends over the beam. When the concrete has hardened the mold pieces are disassembled from around the beam such that the concrete rests on the beam. In most instances, these wide flange beam supported concrete structural members are formed in place. This is usually advantageous so that the concrete surface can better fit into the finished structure. Some types of concrete structural forms, however, are prefabricated.

Despite the utility of the structural members utilized in the past, these members have not been completely satisfactory. Accordingly, it is an object of the present invention to provide an improved composite, pre-stressed structural member.

It is particularly an object of the present invention to provide an improved composite, pre-stressed structural member which is less expensive, lower weight, and/or capable of withstanding larger loads in use.

It is also an object of the present invention to provide an improved method and apparatus for forming composite, pre-stressed structural members of the type described. Particularly, it is an object to provide such a method which is simple, low cost, and results in an improved structural member.

SUMMARY OF THE INVENTION

In accordance with the objects of the present invention, a new method of forming a composite pre-stressed structural member of the type having an upper molded surface supported by a lower support member is provided. In this method, a lower support member is connected to the upper side of a mold so that deflection of the mold causes a parallel deflection of the support member. With the lower support member connected to the upper side of the mold, support member shear connector means extend downwardly into the mold. The connected mold and support member are supported so that deflection of the mold and support member can occur. Following connecting the support member to the mold and supporting them so that deflection can occur, the mold is filled with a moldable material which hardens to form a composite structural member with the lower support member. During hardening of the moldable material, the mold is deflected so that the support member is placed in a stressed condition to form a composite, pre-stressed structural member upon hardening of the moldable material.

In general, the moldable material comprises concrete and the lower support member comprises a steel wide flange beam. Often, more than one beam is utilized.

After hardening of the moldable material, the composite, prestressed structural member is inverted or turned over such that the lower support member is beneath and supports the hardened moldable material. The composite, pre-stressed structural member can then be utilized in a structure such that a stress is placed on the lower support member opposite the stress placed on the lower support member in the deflecting step.

As can be seen, the deflecting step can be at least partially performed by the filling step in that the weight of the moldable material such as concrete will deflect the mold as it is poured into the mold. If necessary, additional deflection of the mold can be achieved by adding weight to the mold or the connected lower support member and mold. The amount of deflection which occurs can easily be calculated through the weight of the moldable material and the additional weights added to the mold and lower support member. This, of course, determines the amount of prestress which remains in the composite, prestressed structural member produced by the method of the present invention.

The method of the present invention produces a composite, prestressed structural member which differs from the structural members utilized in the past. This structural member comprises an upper molded surface formed of a hardened moldable material and a lower support member extending beneath and supporting the upper molded surface material. The lower support member is connected to the upper molded surface in a fixed shear relationship formed by hardening the moldable material beneath the lower support member with the support member placed in a pre-stressed condition due to the weight of the member, the mold, and the moldable material. In this manner, the lower support member is pre-stressed to oppose the stress placed on the structural member when inverted and in use. This allows a lower weight support member to be utilized to support the same amount of load. It also allows greater loads to be supported than were previously supportable. Finally, this composite structural member is able to use less steel and concrete than previous structural members of similar type.

For a further understanding of the invention and further objects, features and advantages thereof, reference may now be had to the following description taken in conjunction with the accompanying drawings.

DESCRIPTION OF PREFERRED EMBODIMENTS

Figure 1:
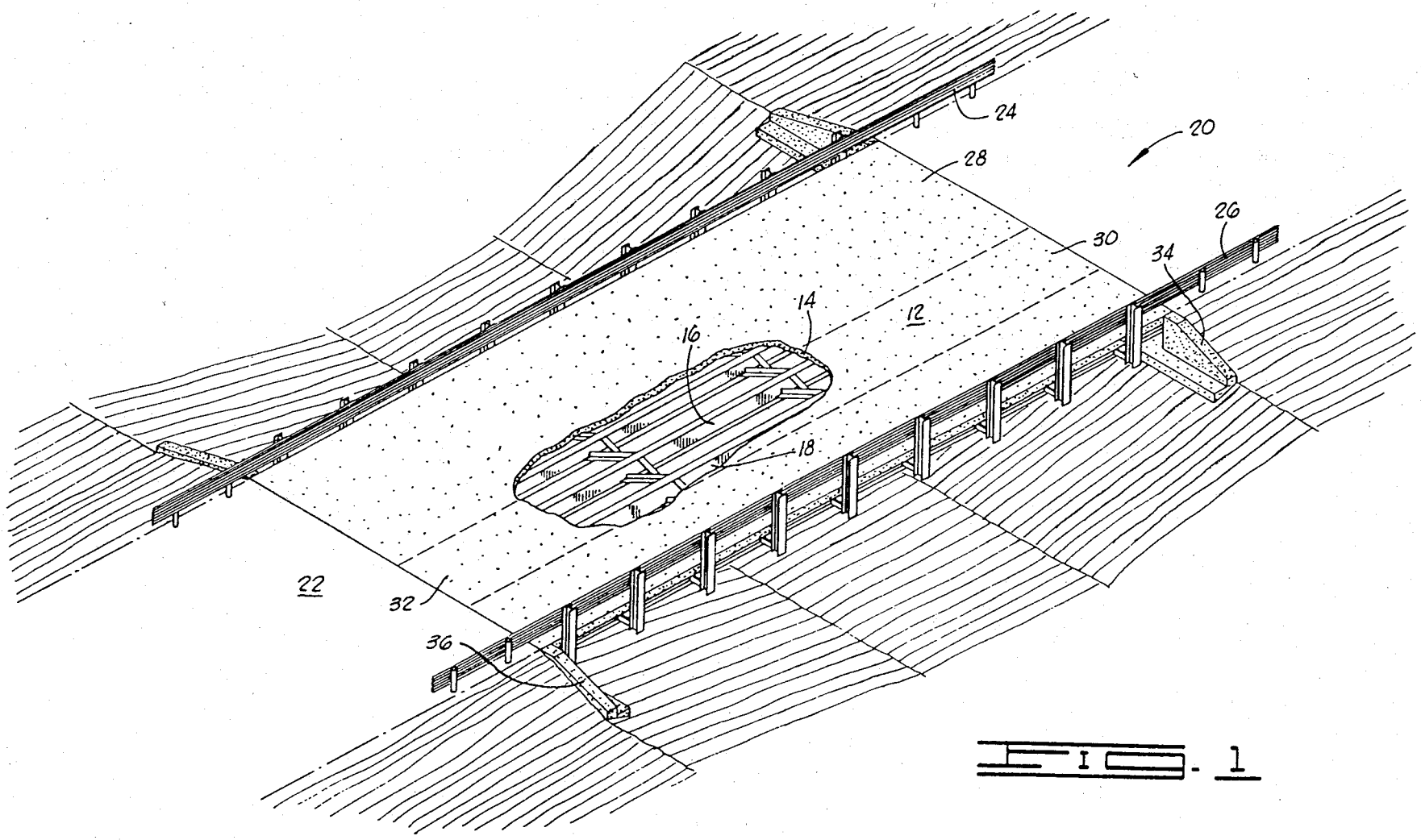
FIG. 1 is a perspective view of a bridge utilizing structural elements and members in accordance with the present invention.

Referring now to FIG. 1, a composite structural element 12 (dotted lines showing its extent) having an upper concrete surface 14 supported by steel wide flange beams 16 and 18 is shown being utilized in a bridge 20. The bridge 20 is part of a roadway 22 and includes guardrails 24 and 26 to protect the sides of the bridge. A layer of asphalt 28 is laid over the concrete surface 14 to provide a smoother bridge surface. However, the concrete 14 and the wide flange beams 16, 18 and others like them, comprise the major structural elements of the bridge 20.

The structural member 12 is supported on its ends 30 and 32 by concrete bridge abutments 34 and 36, respectively. The loads which are placed on the bridge 20 are received by the concrete surface 14, the beams 16 and 18 and the bridge abutments 34 and 36. Although not shown the concrete surface 14 generally includes reinforcement bars which extend through and help support the concrete. For simplicity, these well-known reinforcement bars are not shown or described in the subsequent description. Addition of such bars is within the skill of the art.

The structural member 12 of the present invention differs from prior art structural elements in that the beams 16 and 18 beneath and supporting the concrete surface 14 are pre-stressed to oppose the loads placed on the bridge 20 by the weight of the bridge 20 and by the weight of vehicles on the bridge 20 (dead and live loads). By pre-stressing the beams 16 and 18 and the composite member of which they are a part, the size, weight, and expense of construction are reduced.

Referring now to FIGS. 2–5, the composite structural member 12 is shown in the process of its formation. This shows how the beams 16 and 18 are prestressed during the hardening of the concrete 14.

To allow the concrete 14 to be molded to a proper shape, a mold 38 is utilized. The mold 38 includes longitudinal side forms 40 and 42 constructed of outwardly facing channel beams. It also includes end forms 44 and 46 enclosing the ends of the mold 38. The bottom surface 48 of mold 38 is supported underneath by longitudinally extending channel bars 50, 52, 54 and 56. These pieces are tack welded together to form an elongated rectangular mold for forming the elongated surface strip of concrete 14. Movable inserts can be provided for changing the size of the mold if desired.

Figure 4:
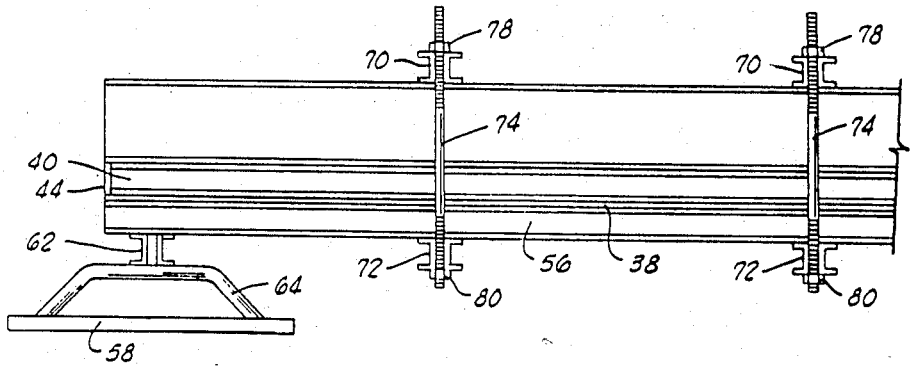
FIG. 4 is a side elevational view of an end portion of the member shown in FIG. 2.
Figure 5:
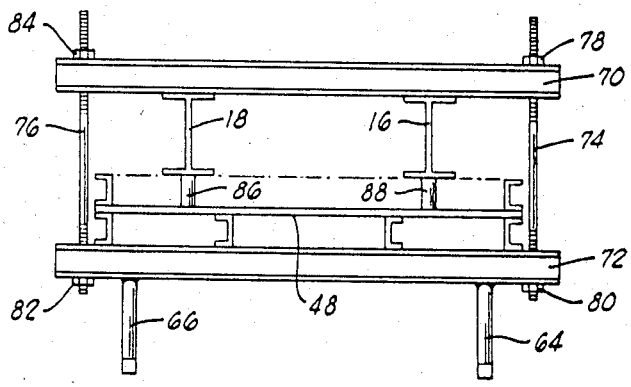
FIG. 5 is an end elevational view of the member shown in FIG. 2

The mold 38 is supported on either end by mold support assemblies 58 and 60. As shown in FIG. 4, these assemblies include a pair of opposed channel bars 62 which extend transversely beneath the channel bars 50, 52, 54 and 56 of the mold 38. Arched bases 64 and 66 extend downwardly from the ends of channel bars 62 so that the channel bars 62 form a raised transverse base for the mold 38. When the mold 38 is supported on its ends by assemblies 58 and 60, it is free to sag in its midportion between the assemblies 58 and 60. It is preferable to make the mold 38 as flexible as possible so that this sag will occur. Inclusion of intentional points of weakness in the mold can produce additional flexibility.

In making the composite, pre-stressed structural member 12 of the present invention, the beams 16 and 18 are positioned above the concrete 14 and its mold 38 as it hardens. This allows the beams to be stressed by the weight of the mold, the beams, and the concrete and then held in this pre-stressed condition when the concrete hardens in a fixed shear relationship with the beams. After its formation, the member 12 is inverted for use for the position shown in FIG. 1.

Extending about the mold 38 and the wide flange beams 16 and 18 are a set of connector and retention assemblies 68 fixedly holding the mold 38 to beams 16 and 18 so that when the mold 38 sags between the mold support assemblies 58 and 60, the wide flange beams 16 and 18 sag in parallel with the mold 38. The connector assemblies 68 include an upper beam 70 and a lower beam 72. Rods 74 and 76 extend through opposite ends of beams 70 and 72 to connect the beams 70 and 72. The distance between beams 70 and 72 can be adjusted by rotating nuts 78, 80, 82 and 84 threadedly attaching the beams 70 and 72 to the rods 74 and 76.

Supporting the wide flange beams 16 and 18 above the mold 38 are spacing blocks 86 and 88. These blocks extend from the bottom of the mold 48 to the beams 16 and 18. It is only necessary to locate blocks such as 86 and 88 just above the mold support assemblies 58 and 60. The retention assemblies 68 and the fact that the beams 16 and 18 are much more rigid than the mold 38 insure that the mold 38 and the beams 16 and 18 deflect together in an amount controlled mainly by the properties of the beams 16 and 18.

In forming the composite, prestressed structural member of the present invention, the mold 38 is first positioned on the mold support assemblies 58 and 60. Next, the beams 16 and 18 are positioned above the mold 38 so that shear connectors 90 and 92 from beams 16 and 18, respectively, extend downwardly into the mold 38. The ends of beams 16 and 18 are supported by blocks 86 and 88 at the ends of mold 38. Next, the connector assemblies 68 are positioned above the mold 38 and beams 16 and 18 and adjusted to provide a uniform distance between the beams 16 and 18 and the bottom of the mold 38. This distance is equal to the intended thickness of the concrete surface 14.

Once the beams 16 and 18 and mold 38 have been properly connected so that they move in parallel during deflection of the beams or mold, concrete is poured into the mold 38 and fills the mold 38 between the bottom 48 of the mold 38 and beams 16 and 18. It covers the shear connectors 90 and 92. As the concrete is added to the mold 38, the mold sags or deflects downwardly due to the weight of the concrete. However, the viscosity of the concrete is sufficient to avoid slumping of the concrete toward the center of the mold as a result of this deflection.

Deflection of the beams 16 and 18 as the concrete is added to the mold 38 pieces the upper portion of the beams 16 and 18 in compression and the lower portions of the beams 16 and 18 (which are adjacent the concrete 14) in tension. The concrete is allowed to harden in mold 38 in this position with the beams in a stressed condition. After the concrete hardens, the mold 38 is removed and the composite structural member formed between the concrete 14 and the beams 16 and 18 is inverted to a position with the concrete uppermost. This places the weight of the concrete on the beams 16 and 18 producing a stress opposite the stress placed on the beams during the hardening process. Thus, the composite member has pre-stressed beams which are better able to support the concrete 14 and structural loads placed upon the concrete 14.

Figure 6:
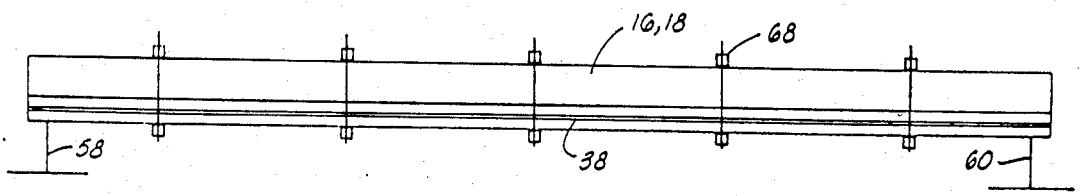
FIG. 6 is a schematic side elevational view of the structural member of the present invention during one of the formation steps.
Figure 7:
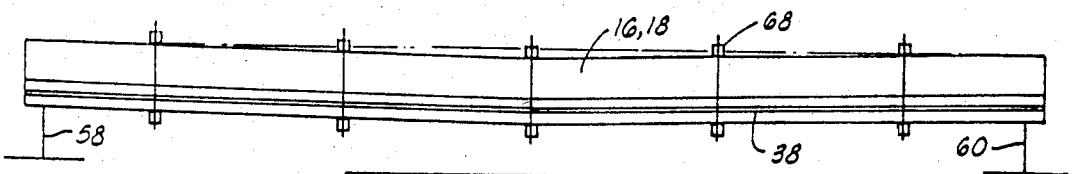
FIG. 7 is a schematic side elevational view of the structural member of the present invention in another step of its formation.
Figure 8:
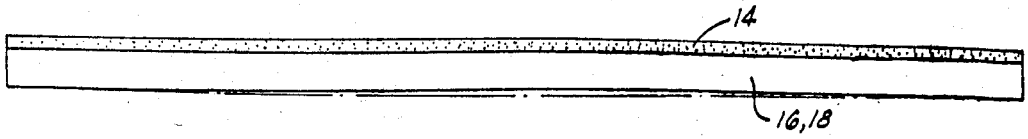
FIG. 8 is a schematic side elevational view of a structural member of the present invention ready for use.

FIGS. 6–8 schematically show the steps of producing the composite member of the present invention. First, the mold 38, beams 16 and 18 and the connector assemblies 68 are positioned so that the ends of the mold 38 and beams 16 and 18 are supported by the mold support assemblies 58 and 60. As shown in FIG. 6, the mold and beams do not sag very much between the mold support assemblies 58 and 60 prior to the addition of concrete to the mold 38. As shown in FIG. 7, the addition of concrete to the mold 38 produces the deflection of mold 38 which gives rise to the pre-stressing of beams 16 and 18. Following the hardening of the concrete 14 in mold 38, the mold is removed and the composite, prestressed structural member is inverted to its normal position as shown in FIG. 8.

Although the composite member is large and heavy, the process of inverting the member can be achieved by attaching a lifting cable to eyelets fastened to the concrete 14 along one side. The composite member is then raised on its side and allowed to hang free. Then, by simultaneously pulling the concrete surface 14 away from the beams the lifting cables can then be used to lower the composite member to the position shown in FIG. 8.

Figure 2:
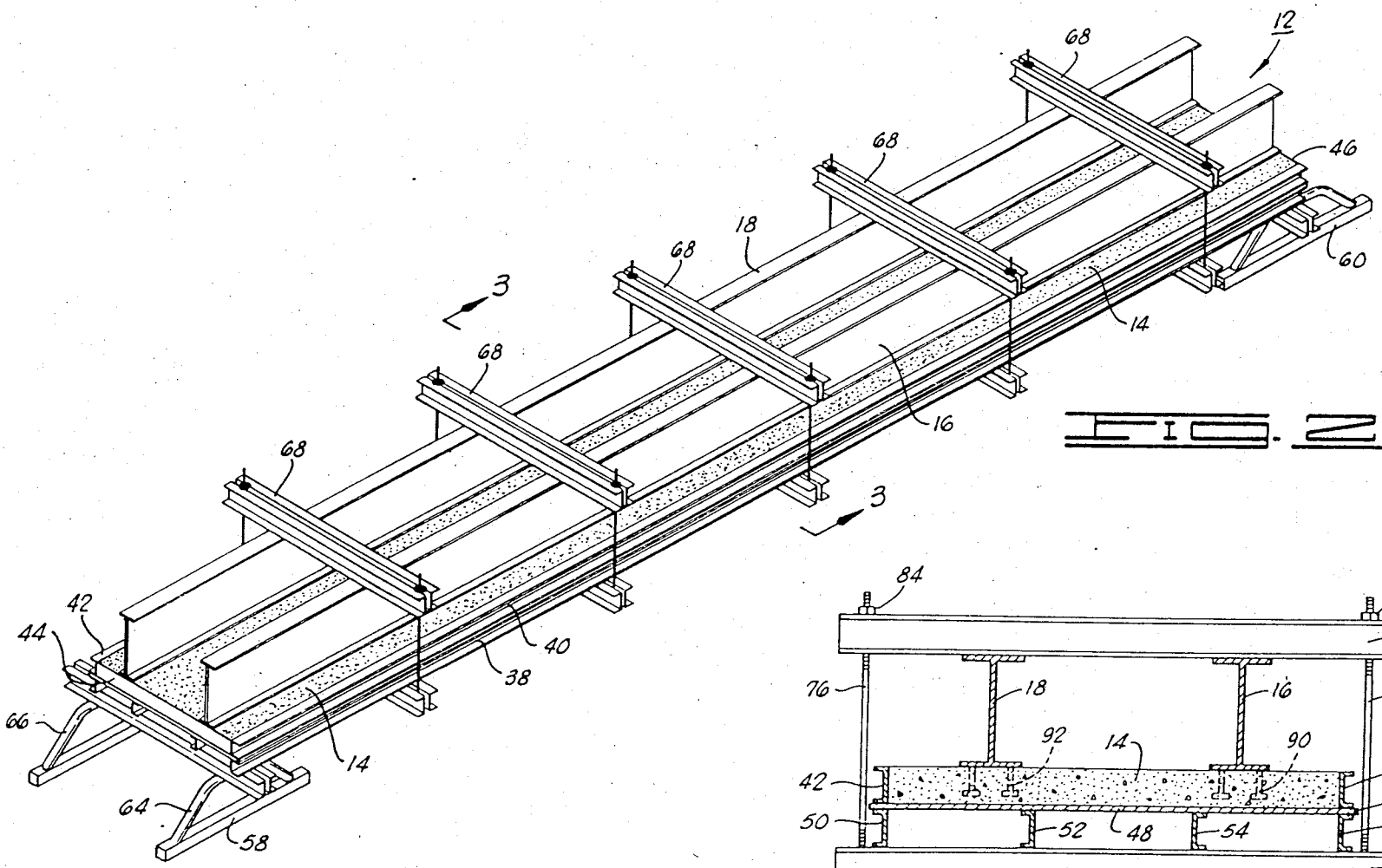
FIG. 2 is a perspective view of a composite, prestressed structural member being formed in accordance with the method and apparatus of the present invention.
Figure 3:
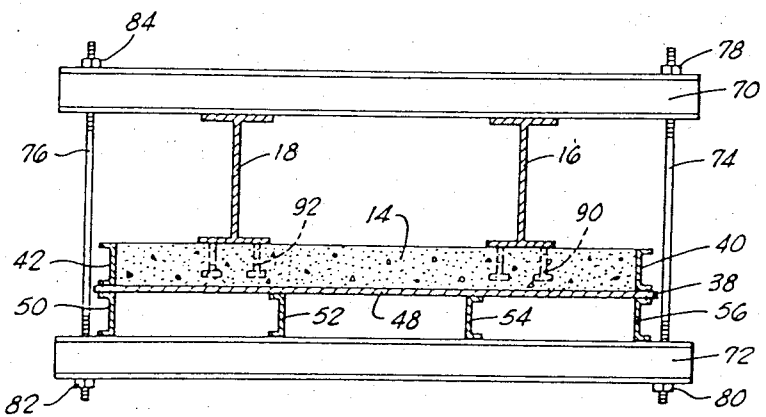
FIG. 3 is a cross-sectional view of the member shown in FIG. 2 taken along the lines indicated.
Figures 9, 10:
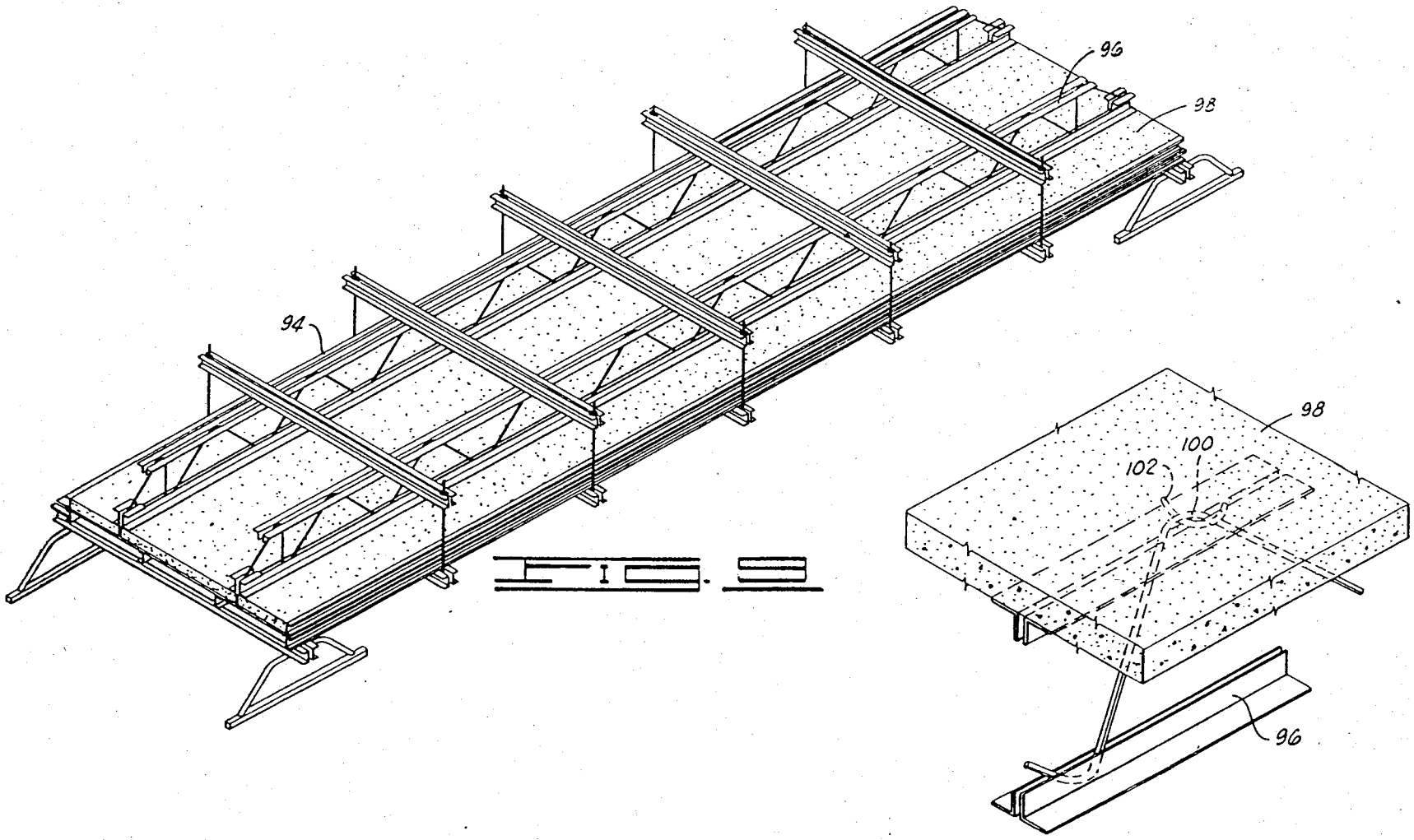
FIG. 9 is a perspective view of an alternate embodiment of the structural member of the present invention during its formation.
FIG. 10 is a view of a section of a structural member of the type shown in FIG. 9.

Referring now to FIG. 9, an alternate embodiment of the present invention is shown in a position similar to that shown in FIG. 2. In this embodiment, instead of wide flange beams 16 and 18, bar joists 94 and 96 are utilized as supports for a concrete floor 98. The method of forming the composite prestressed structural member shown in FIG. 9 is the same as the method described above. However, the bar joists 94 and 96 have a smaller flange portion to which shear connectors can be added. Accordingly, it is desirable to add shear connectors of a different type to bar joists 94 and 96 in order to achieve the composite member of the present invention.

As shown in FIG. 10, the angled bars which extend between the upper and lower flanges of the bar joists 94 and 96 have an elbow section 100 which extends through the flanges. By utilizing a U-shaped shear connector 102 transversely inserted through this elbow 100, the bar joists 94 and 96 can be connected to the concrete 98. If necessary, lead inserts can be wedged into the elbow 100 to hold the shear connectors 102 in a proper orientation during the pouring of the concrete 98.

Another type of support member not shown in any of the FIGS. is a tee-shaped support beam with the flange of the tee located away from the concrete. The base (or vertical leg) of the tee beam extends into the mold and the hardened concrete. For shear connection, bars extending through the entire width of the concrete extend through holes drilled in the base of the tee beam.

Other configurations could be designed to suit particular purposes.

EXAMPLE

The following is an example design showing calculated properties of a structural element of the type shown in FIG. 2. In this example, the concrete element is 6'9" wide by 55' long. The concrete is 7" thick and weighs 150 lbs. per cubic foot. The two wide flange beams are W21×50 and are made of steel having a yield stress of 50,000 psi. In this example the following list of symbols is utilized.

| LIST OF SYMBOLS | |
|---|---|
| A | Cross sectional area (sq. in.) |
| (C) | Compressive Stress (PSI) |
| d | Depth of Section (in.) |
| $f_s$ | Allowable design strength of steel (lbs. per sq. in.) (PSI) |
| $f'_c$ | Ultimate design strength of concrete (PSI) |
| $f_b$, $f_t$ | Calculated stress in bottom or top flange underload (PSI) |
| I | Moment of inertia (in.$^3$) |
| L | Span length (ft.) |
| M | Calculated Moment (ft. - lbs.) |
| $S_b$, $S_t$ | Section Modulus, bottom or top (in.$^3$) |
| (T) | Tensile Stress (PSI) |
| w | Liveload or deadload (lbs. per ft.) (plf) or (lbs. per sq. ft.) (psf) |
| $y_b$, $y_t$ | Distance from neutral axis to |

-continued

| LIST OF SYMBOLS |
|---|
| extreme fiber, bottom or top (in.) |

The concrete and the wide flange beams have the following qualities:

| Concrete | W21 × 50 |
|---|---|
| $f'_c$ = 3,000 psi<br>w = 150 lbs./ft. | A = 14.7<br>I = 984 in$^4$<br>S = 94.5 in$^3$<br>w = 50 lbs./ft.<br>d = 20.84" |

In its inverted position, the position of formation shown in FIG. 2, the 1st stress placed on the end-supported beams occurs due to its own dead load which is 50 lbs./ft. per beam.

$$\text{Beam Load Moment } (M) = \frac{wL^2}{8} = \frac{2(50)(55)^2}{8} = 37{,}813 \text{ ft.-lbs.}$$

$$\text{Stress on bottom flange } (f_b) = \frac{M}{S_b} = M =$$

$$\frac{37{,}813 \text{ (ft. lbs.) } 12 \text{ (in./ft.)}}{2(94.5) \text{ (inches}^3)} = 2{,}401 \text{ psi } (C)$$

The next stress is placed on the beams when the form for the concrete is loaded on the beams. This form weighs 200 lbs./ft.

$$\text{Form Load Moment } (M) = \frac{200\ (55)^2}{8} = 75{,}625 \text{ ft. lbs.}$$

$$f_b = \frac{75{,}625\ (12)}{2(94.5)} = 4{,}802 \text{ psi } (C)$$

$$\Sigma f_b = 2{,}401 + 4{,}802 = 7{,}203 \text{ psi } (C)$$

The next stress placed on the beams results from the pouring of the 7" concrete slab on the form. This load is 6.75 ft. wide and 7" thick for each lineal ft. of span.

$$\text{The weight per ft.} = 6.75 \text{ (ft.)} \times \frac{7 \text{ (inches)}}{12 \text{ (inches/ft.)}} \times 150 \text{ (lbs/ft.}^3) = 591 \text{ lbs./ft.}^3$$

$$\text{Concrete Load Moment} = \frac{591(55)^2}{8} = 223{,}472 \text{ ft. lbs.}$$

$$f_b = \frac{223{,}472(12)}{2(94.5)} = 14{,}189 \text{ psi } (C)$$

$$\Sigma f_b = 7{,}203 + 14{,}189 = 21{,}392 \text{ psi } (C)$$

After the setting of the concrete the unit will now have the properties of a composite section composed of the concrete slab attached to the 2 steel beams. The composite properties are as follows:

$$y_b = 19.91$$

$$I = 6{,}109 \text{ in.}^4$$

$$S_b = \frac{I}{y_b} = \frac{6{,}109}{19.9} = 306.8 \text{ in.}^3$$

After the concrete hardens, the form is removed which has the effect of putting an upward load on the unit of 200 lbs./ft. which results in the same form moment previously calculated of 75,625 ft./lbs. only in the opposite direction.

$$f_b = \frac{75{,}625\ (12)}{306.8} = 2{,}958 \text{ psi } (T)$$

$$\Sigma f_b = 21{,}392 - 2{,}958 = 18{,}434 \text{ psi } (C)$$

The unit will then be turned over and transported (with 3 other similar units) to the bridge site and installed on its bearings which support the unit 6" from each end which reduces the span length from 55' to 54'. The revised moments for the beams and the concrete are as follows:

$$\text{Beam Moment} = \frac{100(54)^2}{8} = 36{,}450 \text{ ft.-lbs.}$$

$$\text{Concrete Moment} = \frac{591(54)^2}{8} = 215{,}420 \text{ ft.-lbs.}$$

The resulting stress on the bottom flange is $$f_b = \frac{2(36{,}450 + 215{,}420)(12)}{306.8} = 19{,}702 \text{ psi } (T)$$

$$\Sigma f_b = 18{,}434 - 19{,}702 = 1{,}268 \text{ psi } (T)$$

To obtain a smoother riding surface for the assembled bridge 4" of asphaltic concrete will be placed on top of the slab. This surfacing will weigh 40 lbs per sw. ft. and for each lineal foot of the 6'9" wide unit the load will be 6.75×40=270 lbs./ft.

$$\text{Asphaltic Concrete Moment} = \frac{270\ (54)^2}{8} = 98{,}415 \text{ ft.-lbs.}$$

$$f_b = \frac{98{,}415(12)}{306.8} = 3{,}849 \text{ psi } (T)$$

$$\Sigma f_b = 1{,}268 + 3{,}849 = 5{,}117 \text{ psi } (T)$$

The final stress placed on the assembled bridge results from the design truck. The share of this truck borne by each unit results in a liveload plus impact moment 534,900 ft./lbs.

$$\text{Live Load plus Impact Moment} = \frac{534{,}900(12)}{306.8} = 20{,}922 \text{ psi}$$

$$\Sigma f_b = 5{,}117 + 20{,}922 = 26{,}039 \text{ psi } (T)$$

$$\text{Allowable Stress} = 27{,}000 \text{ psi } (T)$$

As shown, the example bridge member would utilize W21×50 (21 inches depth, 50 lbs./foot) wide flange beams to support the dead and live loads of the design. In a conventional bridge member utilizing wide flange beams without pre-stress freely supporting a similar concrete surface and with the same live load design, W33×118 (33 inches depth, 118 lbs./foot) wide flange beams must be utilized. Thus, the present invention eliminates over half of the steel weight necessary for supporting the dead and live loads. It also reduces the structural depth of the bridge. Most importantly, it reduces the cost of the materials for the bridge.

It is also apparent that the present invention achieves prestressing of the member in a manner which is dramatically improved over methods where cables are stretched and cut. These methods require calculations, machinery, and labor to separately perform the stretching and cutting of the cables. In the method and apparatus of the present invention, pre-stressing is achieved in the very process which molds the concrete. The design of the member itself as part of the structure achieves the design of the pre-stressing as well.

Another advantage is provided by the ability to prefabricate the members of the present invention. In the prior art, bridges were formed by assembling beams, reinforcement bars, molds and then pouring concrete and disassembling the molds. The concrete had to be poured in the field, cured to the field, and tested in the field. Although the members of the present invention can also be easily prepared in the field, they are also easily prefabricated and transported, after curing and testing, to the field. This makes careful control of the quality easier and the resulting structure less expensive.

Thus, the composite, pre-stressed structural member of the present invention and the method and apparatus for forming the structural member are well adapted to attain the objects and advantages mentioned as well as those inherent therein. While presently preferred embodiments of the invention have been described for the purpose of this disclosure, numerous changes in the construction and arrangement of parts and in the steps of the method can be made by those skilled in the art, which changes are encompassed within the spirit of this invention as defined by the appended claims.

The foregoing disclosure and the showings made in the drawings are merely illustrative of the principles of this invention and are not to be interpreted in a limiting sense.

What is claimed is:

1. A composite pre-stressed structural member comprising:

a lower support means;

an upper hardened molded surface;

a connector means for fixedly joining said lower support means and said upper molded surface in a pre-stressed relationship; and said upper molded surface and the pre-stressed relationship between said upper molded surface and said lower support means having the characteristics of being formed by:

connecting said lower support means to the upper side of a mold so that deflection of the mold causes an approximately parallel deflection of the lower support means and such that said connector means extend downwardly into said mold;

supporting said mold and said lower support means so that deflection of said mold and said lower support means can occur;

filling said mold with a moldable material which hardens to form said hardened molded surface;

said filling of the mold deflecting the mold by the weight of the moldable material such that the lower support means is placed in a stress condition during hardening of the moldable material; and after hardening of the moldable material, inverting said lower support means, said hardened molded surface and said connector means such that the lower support means is beneath and supports the hardened moldable material.

2. The composite, pre-stressed structural member of claim 1 wherein said lower support member comprises a flanged steel beam.

3. The composite, pre-stressed structural member of claim 1 wherein said moldable material comprises a cement mixture.

4. The composite, pre-stressed structural member of claim 1 wherein said connector means comprises a plurality of shear connectors extending from said lower support member.

5. The composite pre-stressed structural member of claim 1 wherein said lower support means comprises a pair of parallel steel beams.

6. A composite, pre-stressed structural member comprising:

a molded upper surface formed of hardened concrete; and a lower metal support member extending beneath and connected by shear connection means to said molded upper surface for supporting loads placed upon said molded upper surface, said connection between said molded upper surface and said lower metal support having a shear stress load thereon formed by hardening said concrete about said shear connection means with said lower metal support member deflected by the weight of said concrete and said lower metal support in an inverted stress position.

7. The structural member of claim 6 wherein said metal support member is a steel beam.

8. The structural member of claim 7 wherein said steel beam is a flanged beam.

9. The structural member of claim 6 wherein said shear connecting means is characterized by a plurality of shear connectors attached to said support member and extending into said concrete.

10. A composite, pre-stressed structural member comprising:

a molded upper surface formed of hardened concrete; and a lower metal support member extending beneath and connected by shear connection means to said molded upper surface for supporting loads placed upon said molded upper surface, said connection between said molded upper surface and said lower metal support having an evenly distributed shear stress load thereon formed by hardening said concrete about said shear connection means with said lower metal support member deflected by a weight of said concrete and said lower metal support in an inverted stress position.

11. The structural member of claim 10 wherein said support member is a flanged beam.

12. The structural member of claim 10 wherein said shear connection means is characterized by a shear connector attached to said support member and extending into said concrete.

13. A composite, pre-stressed structural member comprising:

an upper support surface formed of a hardened moldable material;

a lower support member extending beneath said upper surface for supporting loads placed on said upper surface; and shear connection means for connecting said support member to said upper surface;

wherein, said support member has a pre-stress exerted thereon by deflection of said support member when in an inverted position by a weight thereof and a weight of said moldable material.

14. The structural member of claim 13 wherein said moldable material is concrete.

15. The structural member of claim 13 wherein said support member is a flanged beam.

16. The support member of claim 15 wherein said flanged beam is steel.

17. The structural member of claim 13 wherein said shear connection means is characterized by a shear connector attached to said support member and extending into said moldable material.

* * * * *

UNITED STATES PATENT AND TRADEMARK OFFICE

CERTIFICATE OF CORRECTION

PATENT NO. : 4,700,516

DATED : October 20, 1987

INVENTOR(S) : Stanley J. Grossman

It is certified that error appears in the above-identified patent and that said Letters Patent are hereby corrected as shown below:

Column 1, line 46, delete "it", first occurrence, and insert --is-- therefor; line 50, delete "pre-stresssing" and insert --pre-stressing" therefor.

Column 4, line 60, delete "for", second occurrence, and insert --to-- therefor.

Column 5, line 40, delete "pieces" and insert --places-- therefor.

Column 9, line 13, delete "to" and insert --in-- therefor.

Claim 2, line 2, delete "member" and insert --means-- therefor.

Claim 4, line 4, delete "member" and insert --means-- therefor.

Signed and Sealed this

Ninth Day of August, 1988

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,700,516

DATED : October 20, 1987

INVENTOR(S) : Stanley J. Grossman

It is certified that error appears in the above-identified patent and that said Letters Patent is hereby corrected as shown below:

In the [*] Notice on the title page, delete "January 15, 2001" and insert --January 15, 2002-- therefor.

Signed and Sealed this

Nineteenth Day of May, 1992

*Attest:*

DOUGLAS B. COMER

*Attesting Officer*

*Acting Commissioner of Patents and Trademarks*